US005788554A

United States Patent [19]

Goodwin et al.

[11] Patent Number: 5,788,554

[45] Date of Patent: Aug. 4, 1998

[54] PLUSH PUZZLE TOY

[75] Inventors: Richard P. Goodwin, Bristol, Tenn.; Ralph Bernet, Hong Kong, Hong Kong

[73] Assignee: General Creation International Limited, Bristol, Tenn.

[21] Appl. No.: 729,440

[22] Filed: Oct. 11, 1996

[51] Int. Cl.[6] ..... A63H 3/16

[52] U.S. Cl. ..... 446/100; 446/99; 446/297; 446/901; 446/371

[58] Field of Search ..... 446/99, 100, 97, 446/901, 371, 372, 390, 297, 369; 273/156

[56] References Cited

U.S. PATENT DOCUMENTS

| | | | |
|---|---|---|---|
| 4,869,701 | 9/1989 | Kawai et al. | 446/99 X |
| 5,498,189 | 3/1996 | Townsend | 446/100 |

FOREIGN PATENT DOCUMENTS

| | | | |
|---|---|---|---|
| 20601 | 9/1915 | United Kingdom | 446/371 |
| 2013508 | 8/1979 | United Kingdom | 446/99 |

*Primary Examiner*—Mickey Yu

*Attorney, Agent, or Firm*—G. Brian Pingel

[57] ABSTRACT

A plush toy is provided having a body and plurality of detachable appendages in the form of arms, legs, tail and a head. The appendages are provided with a male member having hook-and-latch material which fits into mating alignment with recesses provided in the body. Hook-and-latch material provided within the recesses secures the appendages securely to the body, while hiding the hook-and-latch material from view. The bodies and appendages may be configured to represent the body and appendages of various animals and may be interchanged to create multi-animal plush toys. Additionally, the heads are provided with switches and audio signal generators to produce audio signals associated with the animals represented by the heads.

14 Claims, 5 Drawing Sheets

PLUSH PUZZLE TOY

BACKGROUND OF THE INVENTION

1. Field of the Invention

The present invention relates in general to a child's plush toy, and, more specifically, to a plush toy having plush appendages releasably secured thereto by hook-and-latch material provided within recesses in the body of the toy.

2. Description of the Prior Art

It is well-known in the art to provide plush toys configured to represent bears, dogs, kittens and other animals. One drawback with such plush toys is the lack of any provision for manipulating the toy or allowing the toy to interchange parts with other similar plush toys to create hybrid toys and stimulate a child's imagination.

While it is known in the art to provide hard plastic toys with interchangeable parts, the hardness of such toys limits their desirability. While it would be desirable to provide a plush toy having such interchangeability, hard materials have heretofore been required to obtain the friction required to prevent interchangeable appendages from inadvertently dislodging from the bodies of the toys. The difficulties encountered hereinabove are substantially eliminated by the present invention.

SUMMARY OF THE INVENTION

The present invention comprises a plush toy having a body and an appendage. The body is provided with a recess into which fits a male member of the plush appendage. The male member is of a size capable of fitting into mating alignment with the recess. Securing means, hook-and-latch material in the preferred embodiment, is secured to both the recess and the male member. The securing means allows releasable attachment of the plush appendage to the plush body upon the insertion of the male member into the recess of the plush body. In the preferred embodiment, the recess is of a sufficient depth to hide the hook-and-latch material from view when the male member is secured within the recess of the plush body.

In the preferred embodiment, the plush body is provided with a plurality of recesses and a plurality of appendages. Legs, arms, a tail and a head are provided to fit into recesses, and are secured by the hook-and-latch material. In a preferred embodiment, when the toy is completely assembled, the toy is substantially indistinguishable from a standard plush toy. Additionally, a plush toy of similar construction, but having features of an animal or doll unrelated to the first toy, may be provided. The similar toy is preferably provided with recesses and male members of a similar size to the first toy to allow the interchangeability of parts between the toys. Furthermore, the heads of the toys may be provided with a switch, an audio signal generating means and a speaker to allow the toy to reproduce sounds of an associated animal when the switch is depressed.

DETAILED DESCRIPTION OF THE PREFERRED EMBODIMENT

Figure 1:
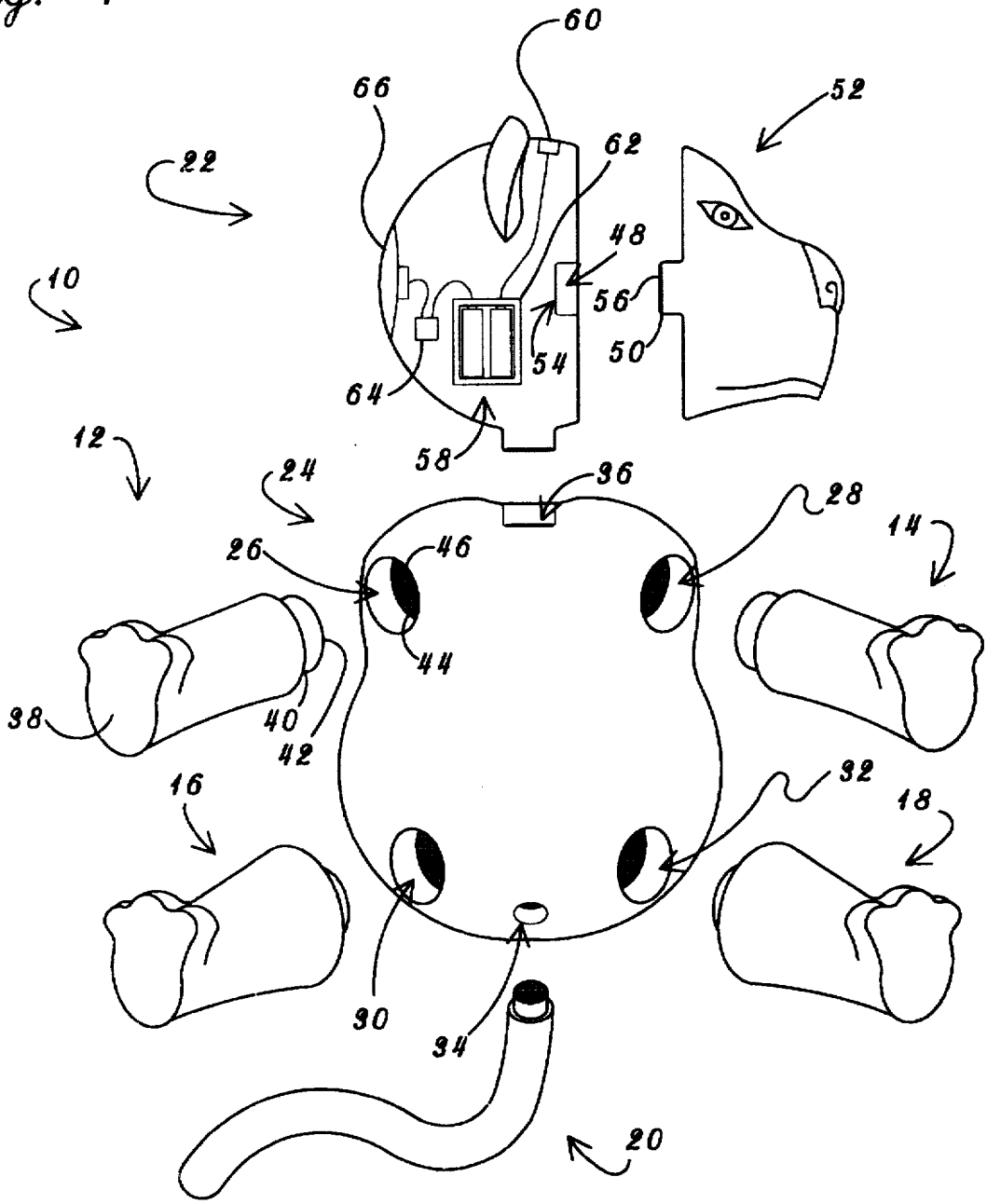
FIG. 1 is an exploded front elevation in partial phantom showing the plush toy of the present invention.
Figure 2:
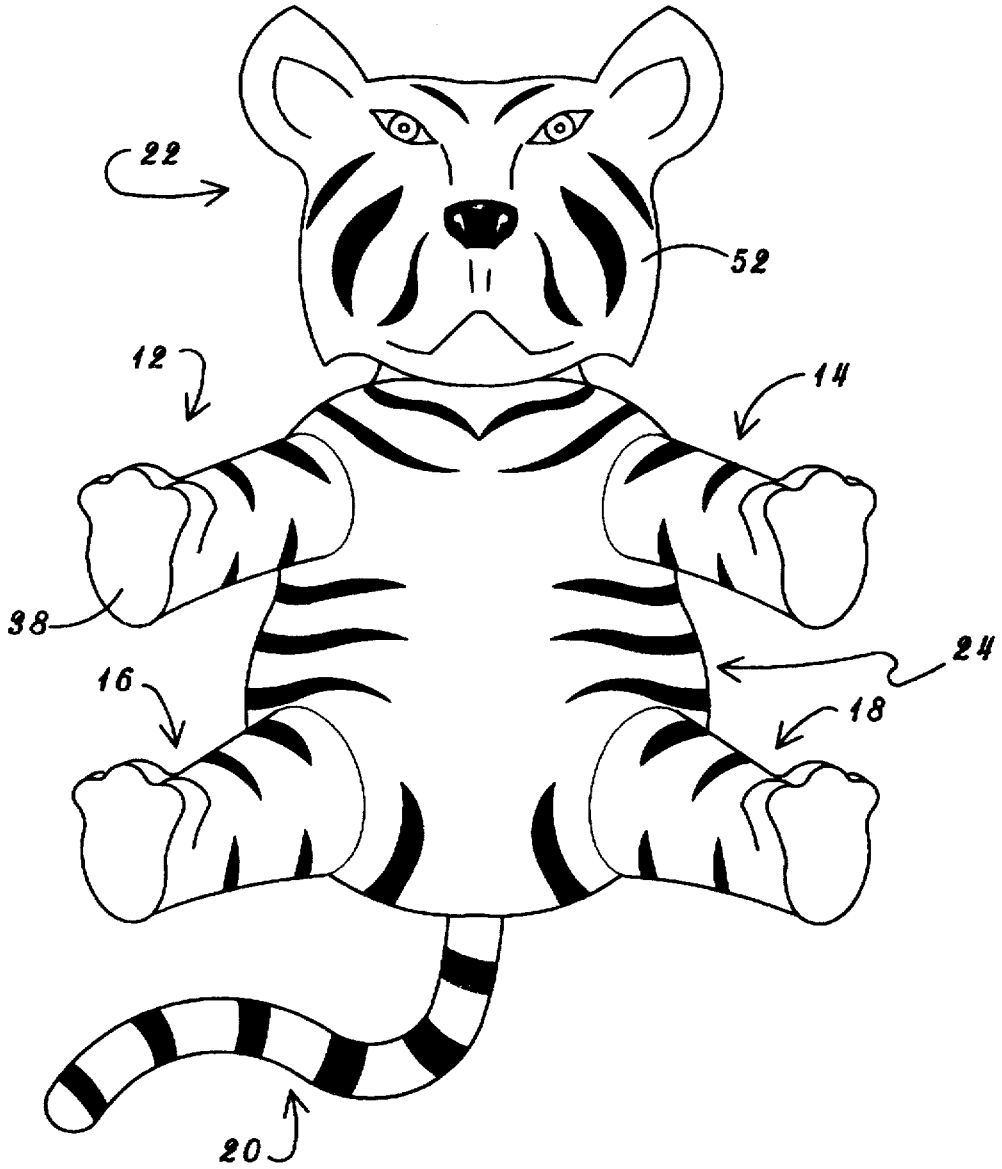
FIG. 2 is a front elevation showing the plush toy of FIG. 1.

With reference to the drawings, a plush toy of the present invention is indicated generally as 10 in FIG. 2. As shown in FIG. 1, the plush toy 10 is in the configuration of a tiger and includes a right arm 12, a left arm 14, a right leg 16, a left leg 18, a tail 20, and a head 22.

The plush toy 10 is also provided with a body 24. Provided in the body 24 are a right arm recess 26, a left arm recess 28, a right leg recess 30, a left leg recess 32, a tail recess 34, and a head recess 36. As shown in FIG. 1, the right arm 12 is provided with a paw section 38 and an upper arm section 40. Secured to the upper arm section 40, is a small piece of hook-and-latch material 42 such as Velcro.® As shown in FIG. 1, the right arm recess 26 is provided with dimensions which match the upper arm section 40 of the right arm 12, preferably a four-centimeter diameter cylinder in the preferred embodiment. The right arm recess 26 is also provided with a base 44 to which is secured a portion of hook-and-latch material 46. The left arm 14, right leg 16, left leg 18, tail 20, and head 22 are all similarly constructed to fit into secured mating alignment with their respective recesses 28, 30, 32, 34 and 36.

As shown in FIG. 1, the head 22 is provided with a recess 48 sized to accommodate a male member 50 of a face section 52. Like the rest of the plush toy 10, the face section 52 and male member 50 are preferably plush to eliminate the undesirability of hard edges on the plush toy 10. Similarly, the recess 48 is provided with hook-and-latch material 54 and the male member 50 is also provided with hook-and-latch material 56.

As shown in FIG. 1, provided within the head 22 is a sound generation system 58 for producing audio signals corresponding to the animal represented by the plush toy 10. The sound generation system 58 is provided with a touch switch 60 which, as shown in FIG. 1, is preferably provided near the top of the head 22 to allow activation by depressing the top of the head 22. The touch switch 60 is coupled to a battery pack 62 which, in turn, is coupled to a signal generator preferably incorporated into an integrated circuit chip 64. As shown in FIG. 1, the integrated circuit chip 64 is coupled to a speaker 66 secured to the rear of the head 22 of the plush toy 10.

To operate the plush toy 10, the right arm 12 is inserted into the right arm recess 26, the left arm 14 is inserted into the left arm recess 28, the right leg 16 is inserted into the right leg recess 30, the left leg 18 is inserted into the left leg recess 30, the tail 20 is inserted into the tail recess 34, the head 22 is inserted into the head recess 36, and the male member 50 of the face section 52 is inserted into the recess 48 of the head 22.

When fully assembled, the plush toy 10 appears to be an ordinary plush toy. The plushness of the appendages and body 24 cover and act to hide the connection points between the appendages and the body 24. Additionally, the plushness of the appendages and body 24 eliminate any uncomfortable hard edges or connectors which would be undesirable in such a plush toy 10. Preferably, the recesses and appendages are uniformly sized so that the appendages may be placed within any of the recesses to form a jumbled plush toy 10 which may be then carried or given to someone to reassemble in the correct orientation.

Figure 3:
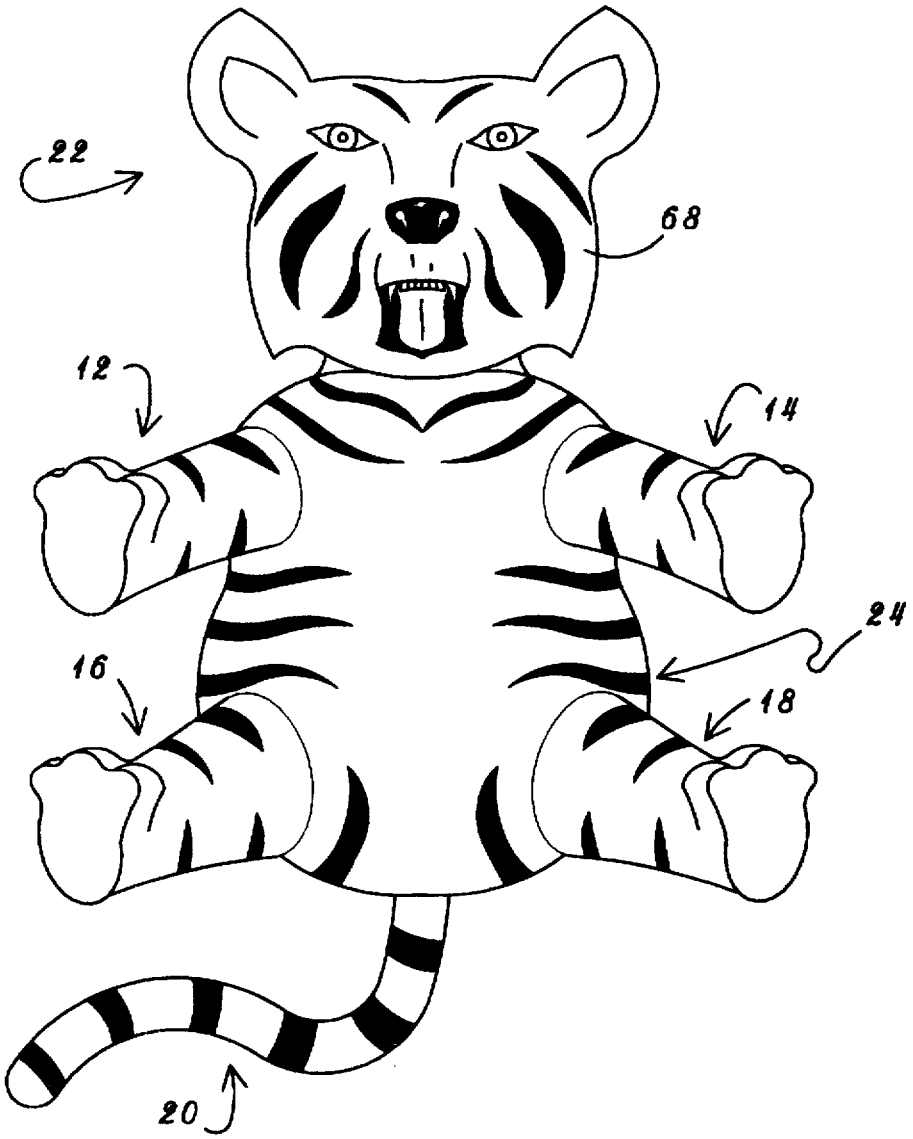
FIG. 3 is the plush toy of FIG. 2 shown with an alternative embodiment face portion connected thereto.
Figure 4:
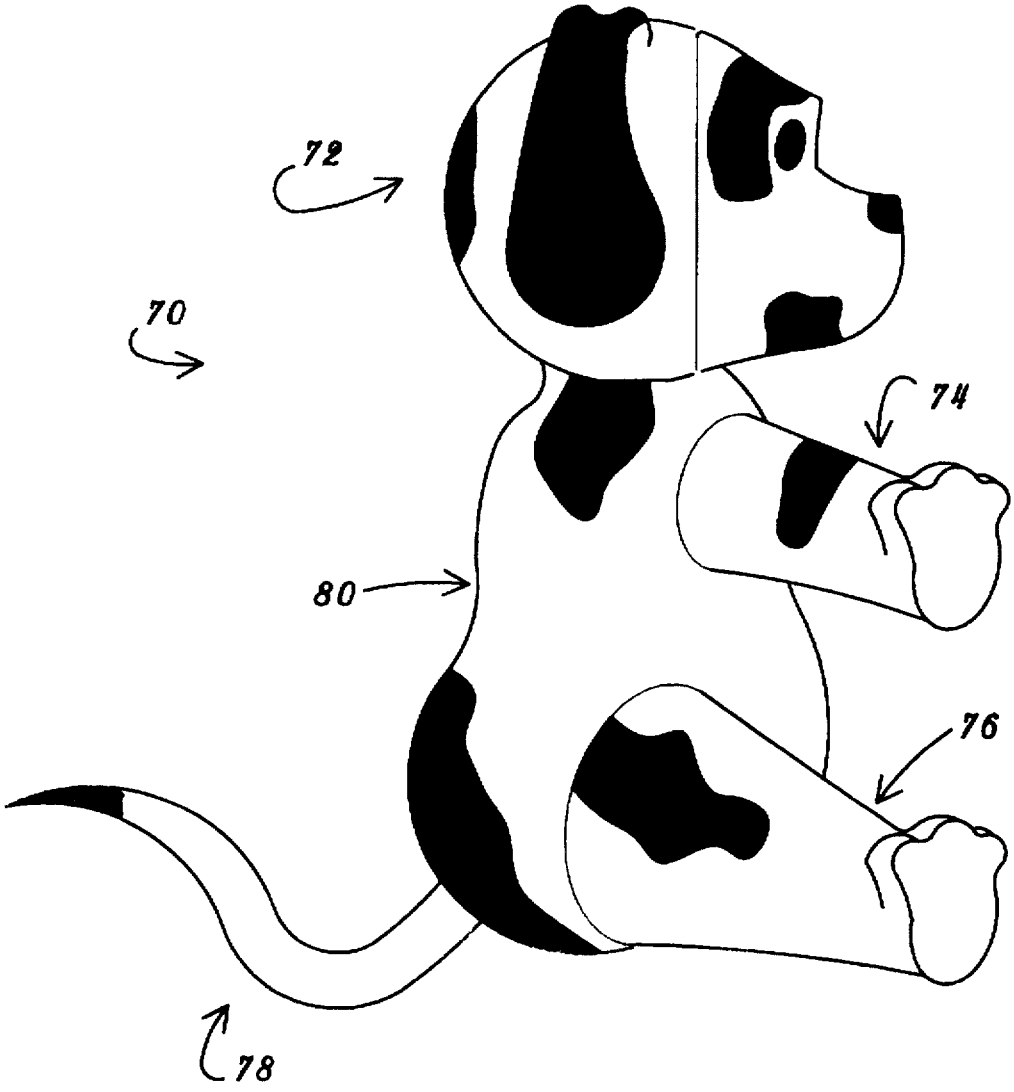
FIG. 4 is a side elevation of an alternative embodiment of the present invention shown with the plush toy in the configuration of a dog.

Shown in FIG. 3 is an alternative embodiment of the present invention in which an alternative face section 68 may be inserted into the head 22 to place a different demeanor on the plush toy 10. Shown in FIG. 4 is yet another alternative embodiment of the present invention in which a plush toy 70 is configured in the shape of a dog. The alternative plush toy 70 is provided with a head 72, a pair of fore legs 74, a pair of hind legs 76, a tail 78 and a body 80.

Figure 5:
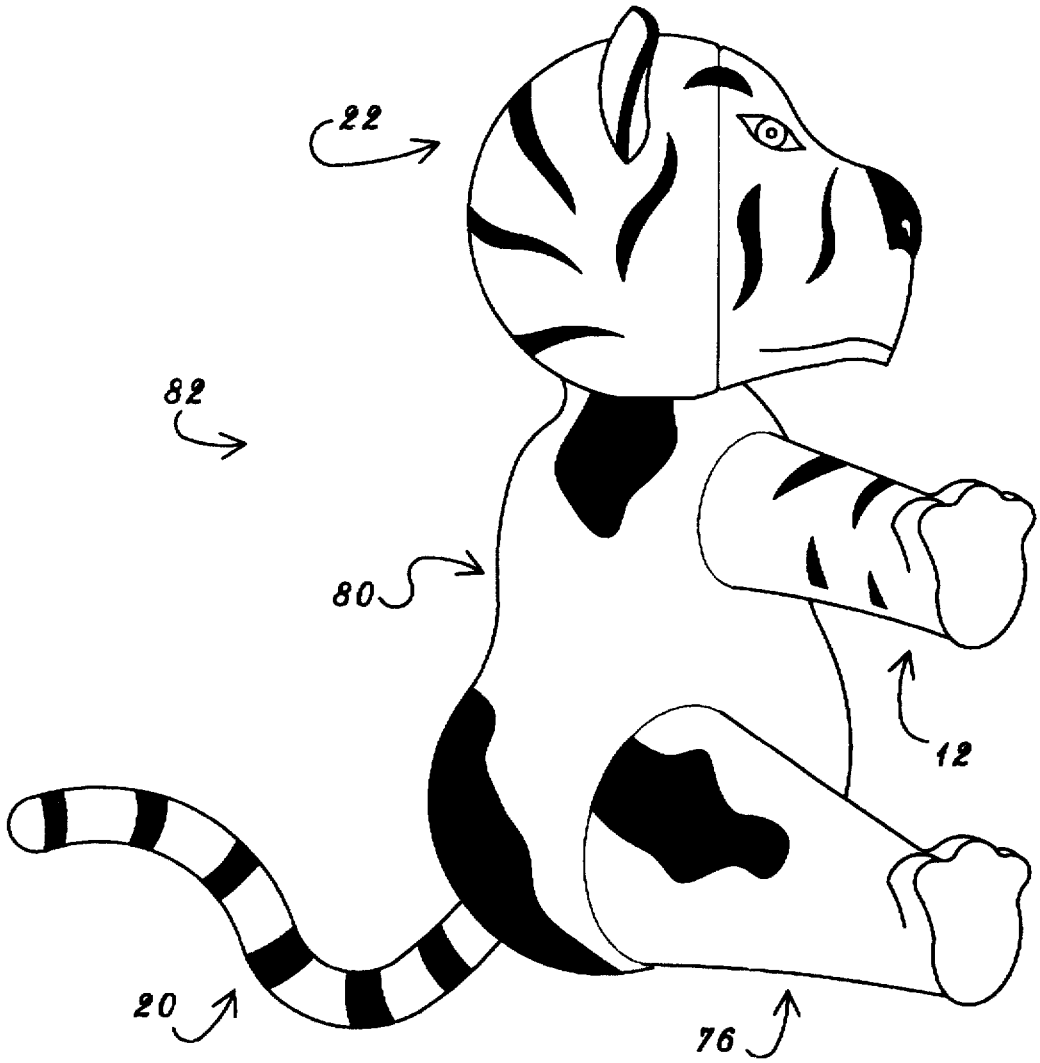
FIG. 5 is a side elevation of a plush toy having portions of the preferred embodiment of the present invention releasably secured to portions of the alternative embodiment of the present invention to form a novel plush toy.

As shown in FIG. 5, the alternative plush toy 70 may be interchangeably connected with the plush toy 10 of the preferred embodiment, wherein the body 80 and hind legs 76 of the alternative plush toy 70 are provided. As shown, the tail 20, right arm 12, and head 22 of the preferred embodiment of the plush toy 10 are secured to the body 80 of the alternative embodiment of the plush toy 70, to create a novel and imaginative toy 82 different from either the preferred embodiment of the plush toy 10 or the alternative embodiment of the plush toy 70. Given the uniformity of the appendages and recesses, the number of different possible combinations for toys is large.

Although the invention has been described with respect to a preferred embodiment thereof, it is to be understood that it is not to be so limited, since changes and modifications can be made therein which are within the full intended scope of this invention as defined by the appended claims. For example, it is anticipated that various styles of plush toys may be created in the form of humans or other various shapes which may be provided with uniform appendages and recesses to be interchanged with one another or with the preferred and alternative embodiments of the present invention noted hereinabove.

What is claimed is:

1. A plush toy comprising:

(a) a plush body having a recess;

(b) a plush appendage having a male member of a size capable of fitting into mating alignment with said recess;

(c) first hook-and-latch means secured within said recess of said plush body for securing said male member of said plush appendage in mating alignment with said recess; and (d) second hook-and-latch means secured to said male member of said plush appendage for co-acting with said first hook-and-latch means to secure said male member of said plush appendage in mating alignment with said recess.

2. The plush toy of claim 1, wherein said recess is of a depth sufficient to hide said first hook-and-latch means and said second hook-and-latch means from view when said male member of said plush appendage is secured in mating alignment with said recess.

3. The plush toy of claim 1, wherein said plush body is provided with a supplemental recess and further comprising:

(a) a supplemental plush appendage having a male member of a size capable of fitting into mating alignment with said supplemental recess;

(b) third hook-and-latch means secured within said supplemental recess of said plush body for securing said male member of said supplemental plush appendage in mating alignment with said supplemental recess; and (c) fourth hook-and-latch means secured to said male member of said supplemental plush appendage for co-acting with said third hook-and-latch means to secure said male member of said supplemental plush appendage in mating alignment with said supplemental recess.

4. The plush toy of claim 3, wherein said supplemental appendage is a head provided with a head recess.

5. The plush toy of claim 4, further comprising:

(a) a plush face having a male member of a size capable of fitting into mating alignment with said head recess;

(b) fifth hook-and-latch means secured within said head recess of said plush body for securing said male member of said plush face in mating alignment with said head recess; and (c) sixth hook-and-latch means secured to said male member of said plush face for co-acting with said fifth hook-and-latch means to secure said male member of said plush face in mating alignment with said head recess.

6. The plush toy of claim 5, further comprising a supplemental plush face having a male member of a size capable of fitting into mating alignment with said head recess, said male member of said supplemental plush face being provided with seventh hook-and-latch means for co-acting with said fifth hook-and-latch means to secure said male member of said supplemental plush face in mating alignment with said head recess.

7. The plush toy of claim 1, wherein said plush body is configured to represent a first animal and wherein said plush appendage is configured to represent a second animal different than first said animal.

8. The plush toy of claim 1, further comprising:

(a) a power source;

(b) a switch provided on said appendage and coupled to said power source;

(c) means coupled to said switch for generating an audio signal; and (d) a speaker coupled to said generating means.

9. The plush toy of claim 8, wherein said appendage is configured in the form of an animal head, and wherein said generating means is of a construction capable of generating an audio signal representative of a sound made by an animal represented by said animal head.

10. A plush toy comprising:

(a) a plush body having a recess, said recess of said body provided with hook-and-latch securement means;

(b) a plush head having a male member provided with hook-and-latch securement means and being of a size capable of fitting into mating alignment with said recess of said body in a manner in which said hook-and-latch material of said recess of said body is not visible, said plush head also being provided with a recess, said recess of said head being provided with hook-and-latch material; and (c) a face having a male member provided with hook-and-latch material and being of a size capable of fitting into mating alignment with said recess of said head in a manner in which said hook-and-latch material of said recess of said head is not visible.

11. The plush toy of claim 10, wherein said plush body is configured to represent a first animal, and wherein said plush head is configured to represent a second animal, different than said first animal.

12. The plush toy of claim 10, wherein said face is configured in the form of a first animal, and further comprising a supplemental face configured in the form of a second animal different than said first animal and having a male member provided with hook-and-latch material, said male member of said supplemental face being of a size capable of fitting into mating alignment with said recess of said head in a manner in which said hook-and-latch material of said recess of said head is not visible.

13. The plush toy of claim 10, further comprising:

(a) a power source;

(b) a switch provided on said appendage and coupled to said power source;

(c) means coupled to said switch for generating an audio signal; and (d) a speaker coupled to said generating means.

14. The plush toy of a claim 13, wherein said appendage is configured in the form of an animal head, and wherein said generating means is of a construction capable of generating an audio signal representative of a sound made by an animal represented by said animal head.

* * * * *